US010279465B2

(12) United States Patent
Chang

(10) Patent No.: US 10,279,465 B2
(45) Date of Patent: May 7, 2019

(54) PLIER HANGER

(71) Applicant: CHUN NIEN PLASTIC LTD., Taichung (TW)

(72) Inventor: Chi-Tsai Chang, Taichung (TW)

(73) Assignee: CHUN NIEN PLASTIC LTD., Taichung (TW)

( * ) Notice: Subject to any disclaimer, the term of this patent is extended or adjusted under 35 U.S.C. 154(b) by 0 days.

(21) Appl. No.: 15/950,538

(22) Filed: Apr. 11, 2018

(65) Prior Publication Data

US 2019/0061138 A1 Feb. 28, 2019

(30) Foreign Application Priority Data

Aug. 25, 2017 (TW) ..... 106212574 U

(51) Int. Cl.
*B25H 3/00* (2006.01)
*B65D 73/00* (2006.01)
*A47F 5/00* (2006.01)

(52) U.S. Cl.
CPC ..... *B25H 3/006* (2013.01); *A47F 5/0006* (2013.01); *B65D 73/0064* (2013.01)

(58) Field of Classification Search
CPC ..... B25H 3/006; A47F 5/0006; A47F 7/028; A47F 7/0028; A47F 2005/0012; B65D 73/0064; B65D 73/005; B65D 73/0021; B65D 73/0007; B65D 73/00
USPC ..... 248/551, 309.1; 206/477, 495, 481, 464, 206/376, 471; 211/70.6
See application file for complete search history.

(56) References Cited

U.S. PATENT DOCUMENTS 3,516,585 A * 6/1970 Inwood ..... B25H 3/006 206/349
5,044,591 A * 9/1991 Huang ..... B65D 73/0014 206/349
6,679,379 B1 * 1/2004 Kao ..... A47F 5/0006 206/349
6,732,989 B1 * 5/2004 Kao ..... A47F 5/0006 206/349
6,874,630 B2 * 4/2005 Lin Wu ..... A47F 5/0006 206/349
2004/0178096 A1 * 9/2004 Kao ..... B65D 73/0064 206/349
2012/0091082 A1 * 4/2012 Chang ..... B65D 73/0021 211/70.6
2013/0056375 A1 * 3/2013 Albrecht ..... B65D 73/0014 206/349

* cited by examiner

*Primary Examiner* — Christopher Garft
(74) *Attorney, Agent, or Firm* — Muncy, Geissler, Olds & Lowe, P.C.

(57) ABSTRACT

A plier hanger is configured to restrict a locking plier which includes a stationary jaw, a stationary handle, a movable jaw and a movable handle, and the plier hanger including a main body and a restricting member. The main body has a penetration portion, a first engaging portion and an assembling portion. The penetration portion is configured for the stationary jaw to be disposed therethrough and the first engaging portion is configured to engage the stationary handle. The restricting member has a second engaging portion and an installation portion. The installation portion is assembled with the assembling portion and the second engaging portion is configured to engage at one side of the stationary handle opposite to the first engaging portion.

10 Claims, 7 Drawing Sheets

PLIER HANGER

BACKGROUND OF THE INVENTION

Field of the Invention

The present invention relates to a plier hanger.

Description of the Prior Art

A plier is indispensable for engineering work or home repair so that every hardware store displays pliers for customers to pick up and buy. The pliers which are displayed in stores are packed with blisters for easy hanging and theft prevention. However, the conventional hangers only allow customers to watch the pliers but customers cannot hold a handle of the plier to try it out so that it is difficult for customers to pick up a suitable product to buy.

The present invention is, therefore, arisen to obviate or at least mitigate the above-mentioned disadvantages.

SUMMARY OF THE INVENTION

The main object of the present invention is to provide a plier hanger, configured to restrict a locking plier for hanging and theft prevention, and the plier hanger allows customers to hold a handle of the locking plier and try it out.

To achieve the above and other objects, the present invention provides a plier hanger, configured to restrict a locking plier which includes a stationary jaw, a stationary handle, a movable jaw and a movable handle, and the plier hanger including a main body and a restricting member. The main body has a penetration portion, a first engaging portion and an assembling portion. The penetration portion is configured for the stationary jaw to be disposed therethrough and the first engaging portion is configured to engage the stationary handle. The restricting member has a second engaging portion and an installation portion. The installation portion is assembled with the assembling portion and the second engaging portion is configured to engage at one side of the stationary handle opposite to the first engaging portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
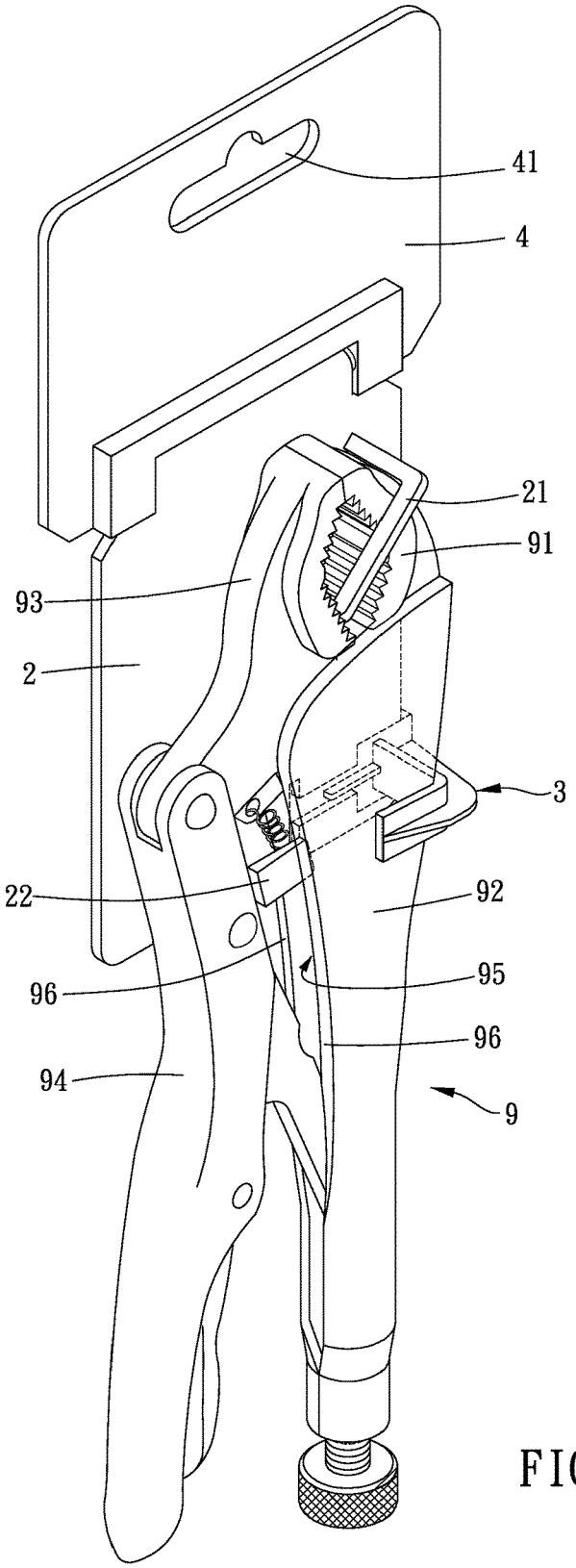
FIG. 1 is a stereogram of a preferable embodiment of the present invention.
Figure 2:
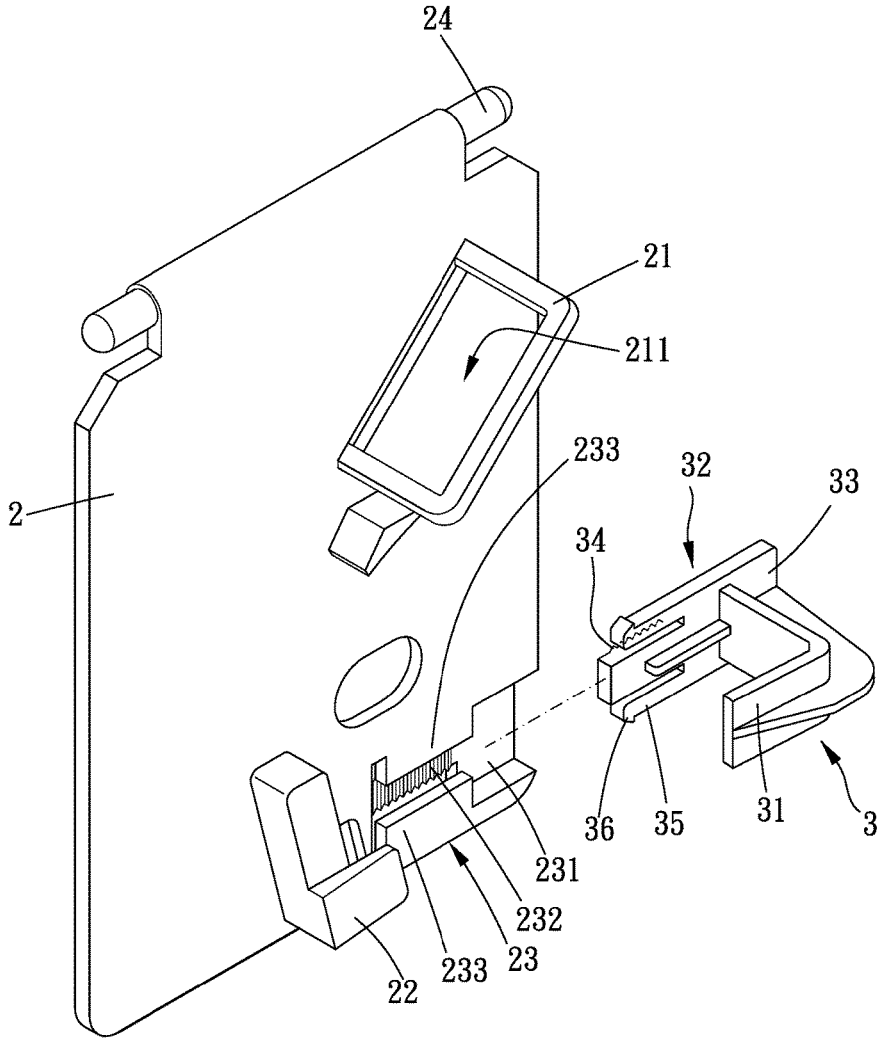
FIGS. 2 and 3 are breakdown drawings of a preferable embodiment of the present invention.
Figure 3:
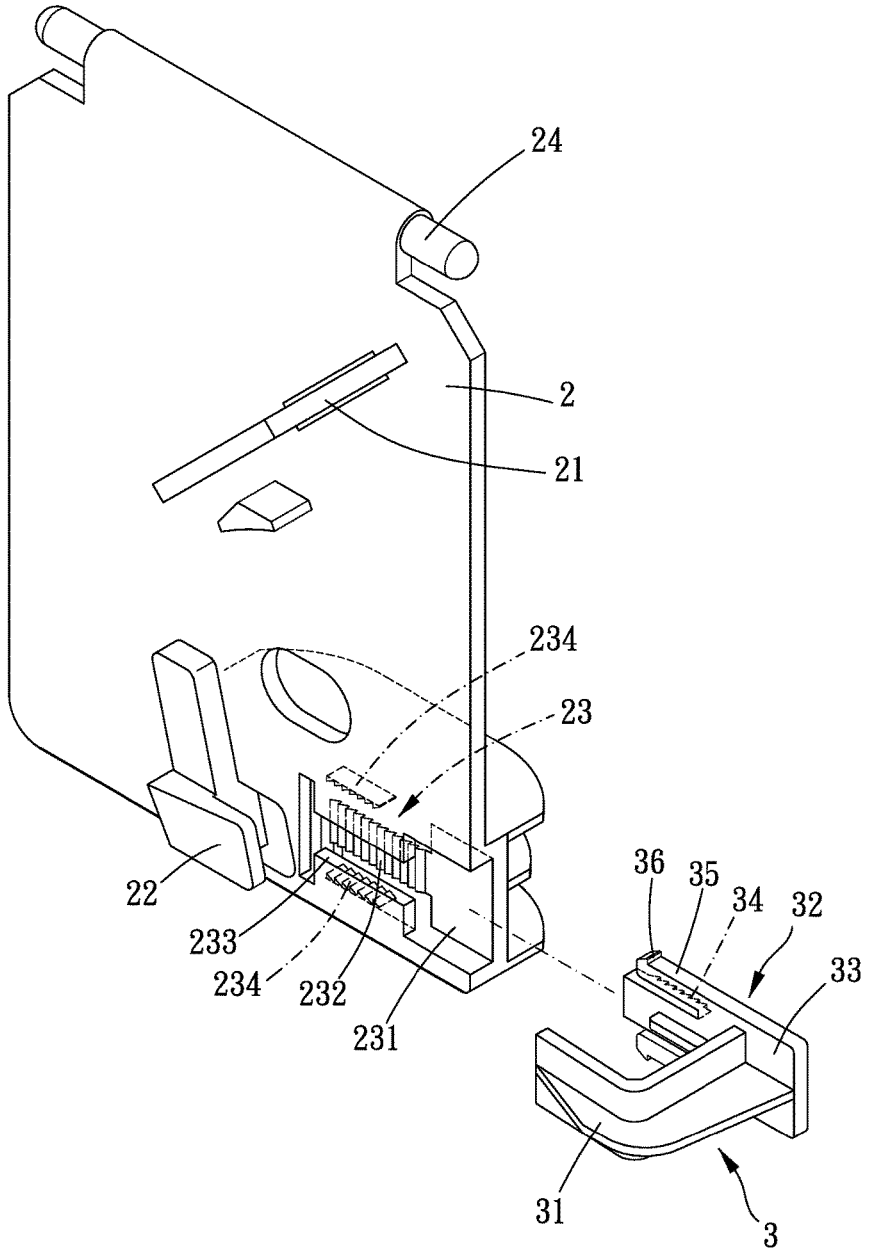
Figure 4:
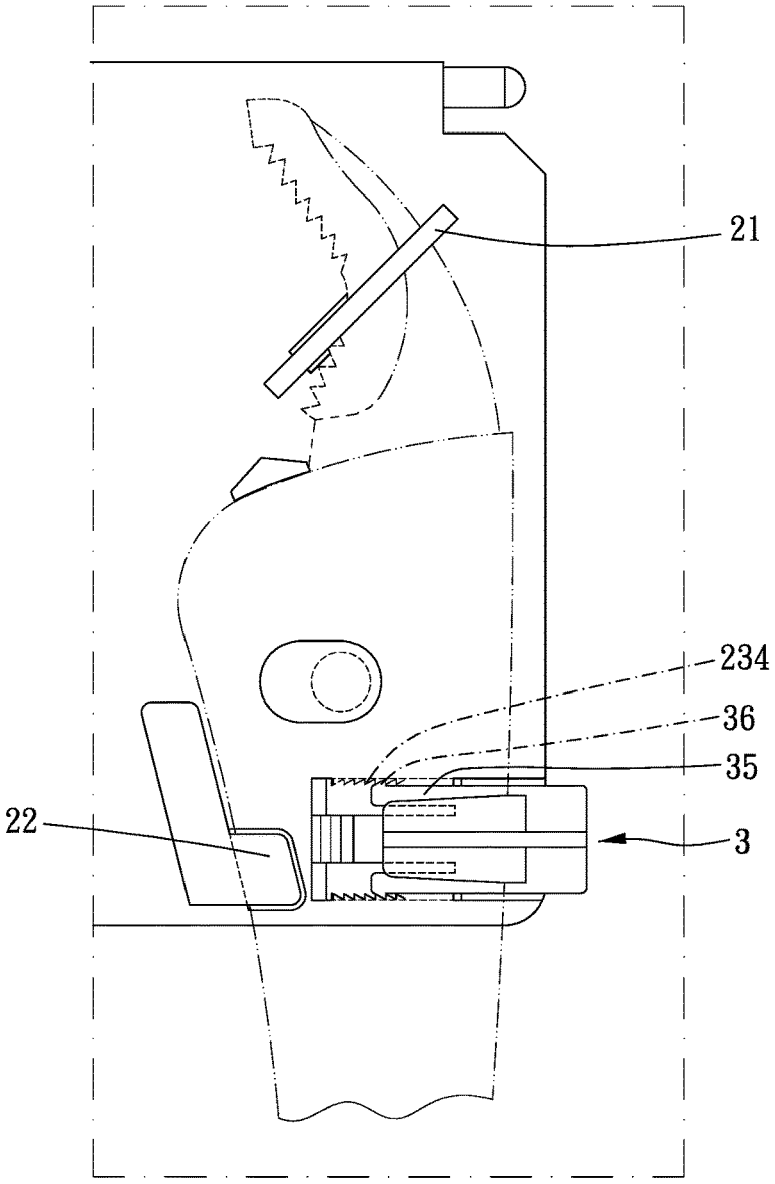
FIG. 4 is a partial side view of a preferable embodiment of the present invention.
Figure 5:
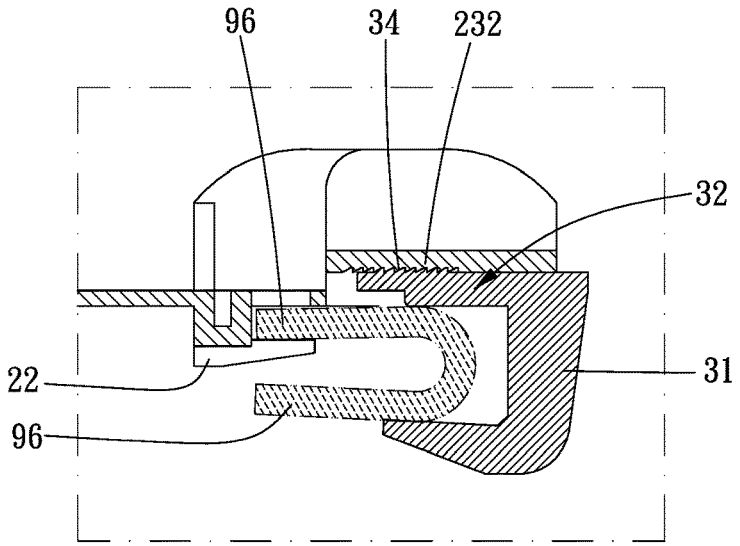
FIGS. 5 and 6 are partial cross-sectional views of a preferable embodiment of the present invention.
Figure 6:
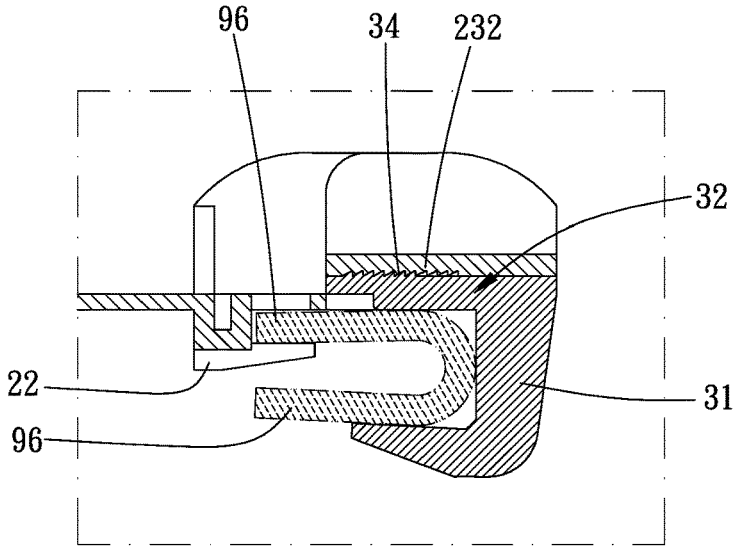

Please refer to FIGS. 1 to 8 for a preferable embodiment of the present invention. A plier hanger of the present invention is provided to restrict a locking plier 9 which includes a stationary jaw 91, a stationary handle 92, a movable jaw 93 and a movable handle 94, the plier hanger including a main body 2 and a restricting member 3.

The main body 2 has a penetration portion 21, a first engaging portion 22 and an assembling portion 23. The penetration portion 21 is configured for the stationary jaw 91 to be disposed therethrough and the first engaging portion 22 is configured to engage the stationary handle 92.

The restricting member 3 has a second engaging portion 31 and an installation portion 32. The installation portion 32 is assembled with the assembling portion 23 and the second engaging portion 31 is configured to engage at one side of the stationary handle 92 opposite to the first engaging portion 22. The penetration portion 21, the first engaging portion 22 and the second engaging portion 31 can restrict the stationary jaw 91 and the stationary handle 92 on the main body 2 to achieve anti-theft effect.

Specifically, the main body 2 is a plate and the penetration portion 21 is protrudingly disposed on the main body 2. The penetration portion 21 has a through hole 211 configured for the stationary jaw 91 to be disposed therethrough to restrict the stationary jaw 91.

In this embodiment, the first engaging portion 22 is disposed on the main body 2 and is configured to be located at one side of the stationary handle 92 which faces the movable handle 94. The side of the stationary handle 92 which faces the movable handle 94 has a slot 95 and the first engaging portion 22 is configured to be engaged with a side plate 96 of the stationary handle 92 near the main body 2. The first engaging portion 22 is preferably integrally formed as a part of the main body 2. The first engaging portion 22 and the second engaging portion 31 are L-shaped hooks, which can firmly engage with the stationary handle 92.

The assembling portion 23 is disposed on the main body 2 and is configured to be located at one side of the stationary handle 92 away from the movable handle 94, and the second engaging portion 31 is configured to be engaged with a side plate 96 of the stationary handle 92 away from the main body 2. In other embodiments, the first engaging portion 22 may be interchangeable with the restricting member 3 in position, and the stationary jaw 91 and the stationary handle 92 can also be restricted on the main body 2.

Specifically, the installation portion 32 is a slider 33, and the slider 33 and the second engaging portion 31 are formed integrally. The main body 2 has a groove 231, and the slider 33 is slidably disposed within the groove 231. Preferably, a first ratchet portion 232 is disposed on one side of a bottom wall of the groove 231 which faces the restricting member 3, and one side of the slider 33 corresponding to the first ratchet portion 232 has a second ratchet portion 34 ratchetably engageable with the first ratchet portion. Through engagement of the first ratchet portion 232 and the second ratchet portion 34, the slider 33 cannot depart from the groove 231, which can effectively achieve anti-theft effect.

Figure 7:
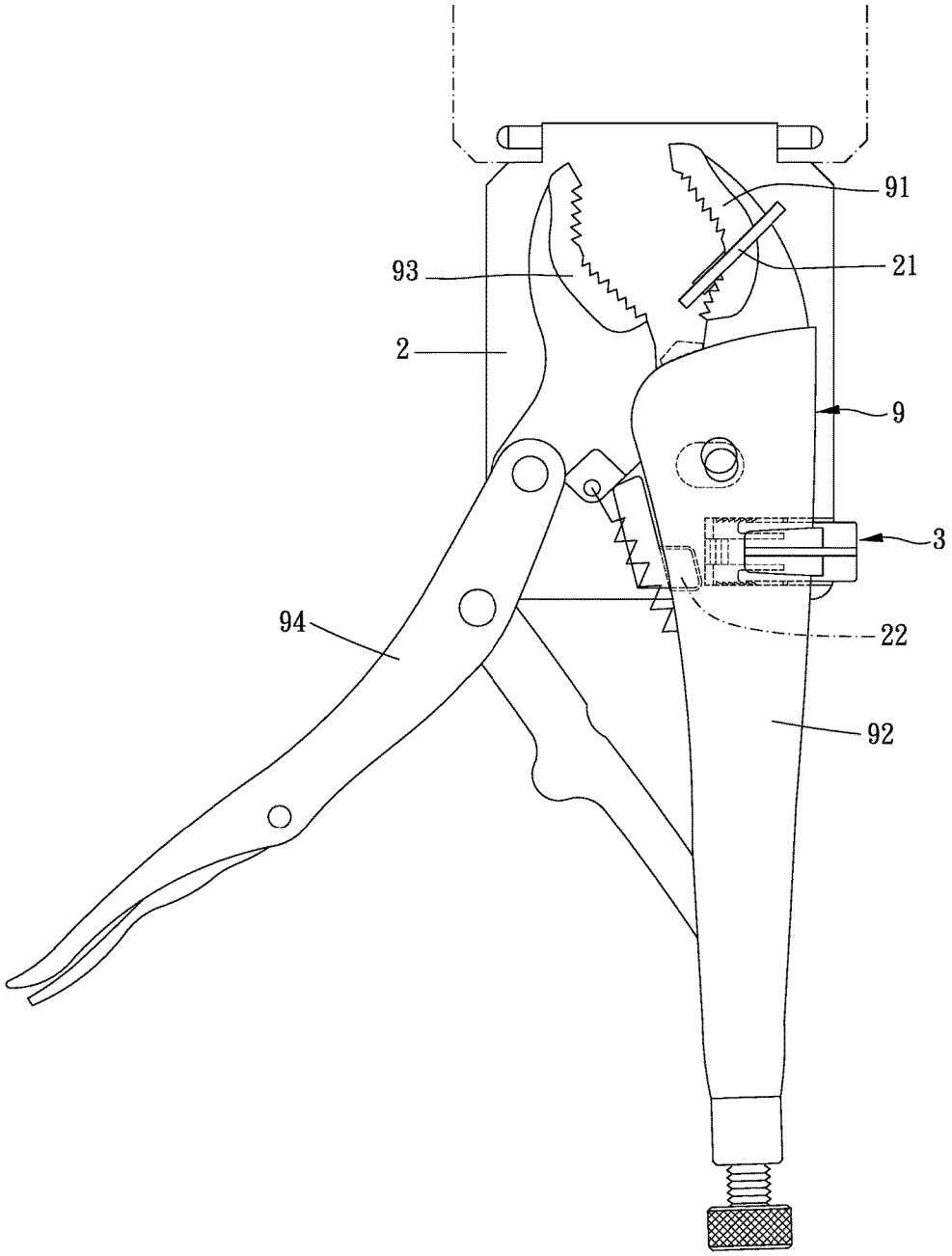
FIGS. 7 and 8 are assembly diagrams of a preferable embodiment of the present invention.
Figure 8:
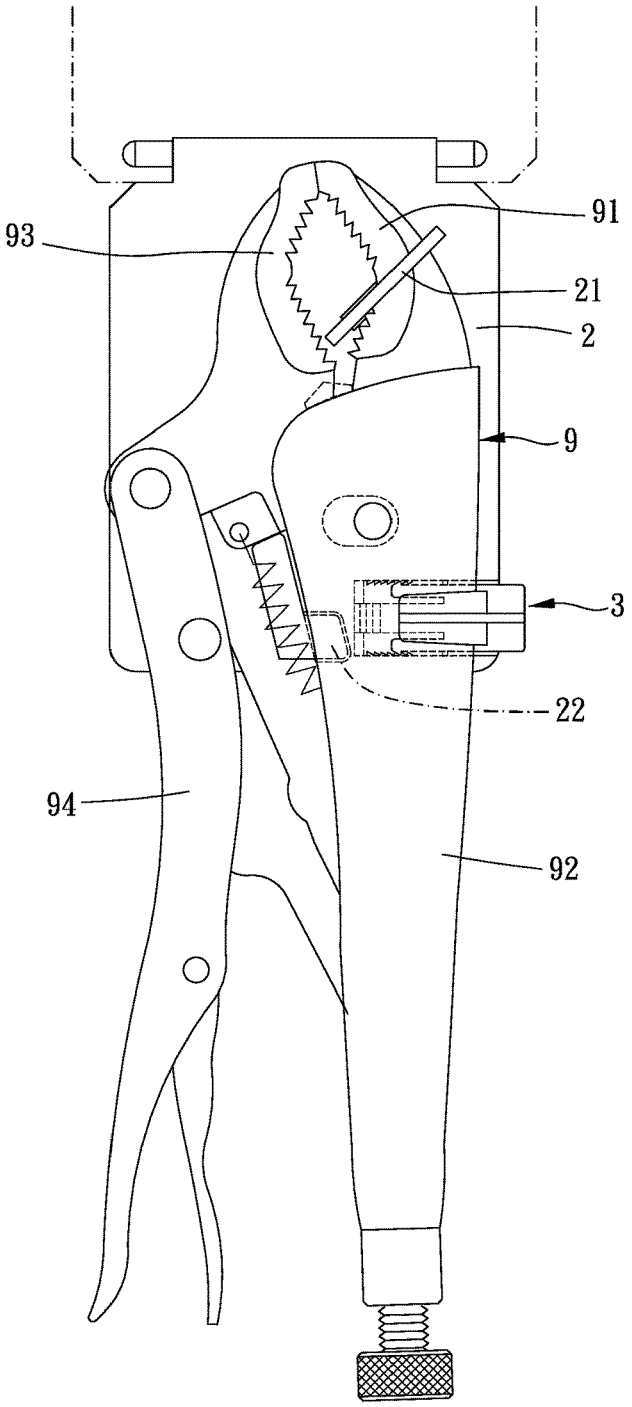

During assembling, the stationary jaw 91 of the locking plier 9 is disposed through the penetration portion 21 and the first engaging portion 22 is engaged with a side plate 96 of the stationary handle 92 near the main body 2, and then the slider 33 is slidably disposed within the groove 231 of the assembling portion 23 so that the stationary jaw 91 and the stationary handle 92 are restricted on the main body 2. The plier hanger is simple in structure and easy to assemble. Furthermore, the movable jaw 93 and the movable handle 94 are free of restriction by the plier hanger so that customers can hold the locking plier 9 and press the movable handle 94 to try it out (as shown in FIG. 7 and FIG. 8).

Two sides of an opening of the groove 231 further have two blocks 233, and the slider 33 is disposed between the two blocks 233 and the bottom wall of the groove 231 so that the slider 33 can be smoothly and slidably disposed within the groove 231 and the second ratchet portion 34 is ratchetably engageable with the first ratchet portion 232.

Preferably, each of two side walls of the groove 231 has a third ratchet portion 234, and the slider 33 further has two legs 35. Each of the two legs 35 further has a hook 36 which is engageable with the third ratchet portion 234 to have better anti-theft effect.

In this embodiment, the plier hanger further includes a hanging member 4, and the hanging member 4 has a hanging hole 41. The main body 2 further has a pivot portion 24, and the pivot portion 24 is pivotally connected to the hanging member 4. The hanging member 4 facilitates convenient hanging of the main body 2 for customers to pick up and buy. In addition, the main body 2 is pivotally connected to the hanging member 4 so that customers can hold and try out the locking plier 9.

In summary, the plier hanger of this invention is configured to be assembled to a locking plier for hanging and theft prevention. The plier hanger is simple in structure and easy to assemble, and allows customers to hold a handle of a plier and try it out.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A plier hanger, configured to restrict a locking plier which includes a stationary jaw, a stationary handle, a movable jaw and a movable handle, including:

a main body, having a penetration portion, a first engaging portion and an assembling portion, the penetration portion being configured for the stationary jaw to be disposed therethrough, the first engaging portion being configured to engage the stationary handle;

a restricting member, having a second engaging portion and an installation portion, the installation portion being assembled with the assembling portion, the second engaging portion being configured to engage at one side of the stationary handle opposite to the first engaging portion, wherein the installation portion is a slider, the slider and the second engaging portion are formed integrally, the main body has a groove, and the slider is slidably disposed within the groove.

2. The plier hanger of claim 1, wherein the main body is a plate, the penetration portion is protrudingly disposed on the main body, and the penetration portion has a through hole configured for the stationary jaw to be disposed therethrough.

3. The plier hanger of claim 1, wherein the first engaging portion is disposed on the main body and is configured to be located at one side of the stationary handle which faces the movable handle, the side of the stationary handle which faces the movable handle has a slot, the first engaging portion is configured to be engaged with a side plate of the stationary handle near the main body.

4. The plier hanger of claim 1, wherein the assembling portion is disposed on the main body and is configured to be located at one side of the stationary handle away from the movable handle, and the second engaging portion is configured to be engaged with a side plate of the stationary handle away from the main body.

5. The plier hanger of claim 1, wherein a first ratchet portion is disposed on one side of a bottom wall of the groove which faces the restricting member, and one side of the slider corresponding to the first ratchet portion has a second ratchet portion ratchetably engageable with the first ratchet portion.

6. The plier hanger of claim 5, wherein two sides of an opening of the groove further have two blocks, and the slider is disposed between the two blocks and the bottom wall of the groove.

7. The plier hanger of claim 6, wherein each of two side walls of the groove has a third ratchet portion, the slider further has two legs, each of the two legs further has a hook which is engageable with the third ratchet portion.

8. The plier hanger of claim 1, wherein the first engaging portion is integrally formed as a part of the main body, and the first engaging portion and the second engaging portion are L-shaped hooks.

9. The plier hanger of claim 1, wherein further has a hanging member, the hanging member has a hanging hole, the main body further has a pivot portion, and the pivot portion is pivotally connected to the hanging member.

10. The plier hanger of claim 7, wherein the main body is a plate, the penetration portion is protrudingly disposed on the main body, and the penetration portion has a through hole configured for the stationary jaw to be disposed therethrough; the first engaging portion is disposed on the main body and is configured to be located at one side of the stationary handle which faces the movable handle, one side of the stationary handle which faces the movable handle has a slot, the first engaging portion is configured to be engaged with a side plate of the stationary handle near the main body; the assembling portion is disposed on the main body and is configured to be located at a side of the stationary handle away from the movable handle, and the second engaging portion is configured to be engaged with a side plate of the stationary handle away from the main body; the first engaging portion is integrally formed as a part of the main body, and the first engaging portion and the second engaging portion are L-shaped hooks; the plier hanger further has a hanging member, the hanging member has a hanging hole, the main body further has a pivot portion, and the pivot portion is pivotally connected to the hanging member.

* * * * *